US007174754B2

(12) United States Patent
Gahlhoff, Jr. et al.

(10) Patent No.: US 7,174,754 B2
(45) Date of Patent: Feb. 13, 2007

(54) KEY FOR ENGAGING A LOCKING MECHANISM OF A PORT COVER FOR PROTECTING FROM UNAUTHORIZED ACCESS ONE OR MORE PORTS OF A SYSTEM INTEGRATED INTO A STRUCTURE FOR INJECTION OF A MATERIAL INTO ONE OR MORE CAVITIES IN THE STRUCTURE

(75) Inventors: Jeryl E. Gahlhoff, Jr., Frisco, TX (US); Robert M. Swartz, Dallas, TX (US)

(73) Assignee: Centex Corporation, Dallas, TX (US)

( * ) Notice: Subject to any disclaimer, the term of this patent is extended or adjusted under 35 U.S.C. 154(b) by 0 days.

(21) Appl. No.: 11/344,623

(22) Filed: Jan. 31, 2006

(65) Prior Publication Data

US 2006/0123860 A1 Jun. 15, 2006

Related U.S. Application Data

(60) Division of application No. 11/039,177, filed on Jan. 20, 2005, which is a continuation of application No. 10/970,071, filed on Oct. 20, 2004.

(60) Provisional application No. 60/572,288, filed on May 18, 2004.

(51) Int. Cl.
*B65D 55/14* (2006.01)
*E05B 19/02* (2006.01)

(52) U.S. Cl. ..... 70/168; 70/172; 70/404; 70/491

(58) Field of Classification Search ..... 70/158, 70/DIG. 69, 163–173, 403, 404, 491, 387, 70/345, DIG. 34, DIG. 68; 43/124, 131; 220/210, 315
See application file for complete search history.

(56) References Cited

U.S. PATENT DOCUMENTS

| | | | | | |
|---|---|---|---|---|---|
| 897,046 | A * | 8/1908 | Armstrong | 70/169 |
| 1,015,907 | A * | 1/1912 | Ryder | 220/246 |
| 1,083,438 | A * | 1/1914 | Dohse | 70/100 |
| 1,271,096 | A * | 7/1918 | Stewart et al. | 70/166 |
| 1,363,599 | A * | 12/1920 | Hull et al. | 70/33 |
| 1,375,521 | A * | 4/1921 | Lasky | 70/75 |
| 1,382,577 | A * | 6/1921 | Vauclain et al. | 301/108.5 |
| 2,283,371 | A * | 5/1942 | Johnson | 70/168 |
| 3,083,896 | A * | 4/1963 | Cairelli et al. | 232/15 |

(Continued)

*Primary Examiner*—Lloyd A. Gall
(74) *Attorney, Agent, or Firm*—Baker Botts L.L.P.

(57) ABSTRACT

In certain embodiments, the present invention includes a key for engaging a locking mechanism for a port cover for use in a system integrated into a structure for injection of a material into one or more cavities in the structure. The locking mechanism is for removably securing a cover of the port cover to a base of the port cover that is coupled to the structure and includes one or more ports for injecting material into the one or more cavities in the structure. The key is adapted to engage with the locking mechanism, and orient the locking mechanism such that the locking mechanism engages with a projection of the base to removably secure one or more tabs of the cover in engagement with one or more corresponding slots of the base to removably secure the cover to the base to prevent unauthorized access to the one or more ports.

13 Claims, 8 Drawing Sheets

U.S. PATENT DOCUMENTS 3,104,052 A * 9/1963 Nemsky ..... 232/4 R
3,248,915 A * 5/1966 Scheiman ..... 70/168
3,422,646 A * 1/1969 Monahan ..... 70/491
3,477,261 A * 11/1969 Siana ..... 70/427
3,812,279 A * 5/1974 Voegeli ..... 174/38
4,045,983 A * 9/1977 Hughes ..... 70/404
4,377,243 A * 3/1983 Shaw et al. ..... 220/210
4,506,529 A * 3/1985 Armbruster et al. ..... 70/168
4,584,856 A * 4/1986 Petersdorff et al. ..... 70/57
4,742,641 A * 5/1988 Cretti ..... 43/132.1
4,893,434 A * 1/1990 Knipp et al. ..... 43/124
4,899,565 A * 2/1990 Steinbach ..... 70/491
4,944,110 A * 7/1990 Sims ..... 43/124
5,024,072 A * 6/1991 Lee ..... 70/491
5,097,686 A * 3/1992 Plumer ..... 70/232
5,245,143 A * 9/1993 James et al. ..... 200/43.08
5,402,661 A * 4/1995 Markisello ..... 70/394
5,402,662 A * 4/1995 Osada ..... 70/491
5,544,512 A * 8/1996 Shieh ..... 70/491
5,970,756 A * 10/1999 Miller et al. ..... 70/168
6,874,274 B2 * 4/2005 Townsend ..... 43/131
2002/0178648 A1 * 12/2002 Frasier ..... 43/131
2005/0198806 A1 * 9/2005 Gahlhoff et al. ..... 29/464

* cited by examiner

KEY FOR ENGAGING A LOCKING MECHANISM OF A PORT COVER FOR PROTECTING FROM UNAUTHORIZED ACCESS ONE OR MORE PORTS OF A SYSTEM INTEGRATED INTO A STRUCTURE FOR INJECTION OF A MATERIAL INTO ONE OR MORE CAVITIES IN THE STRUCTURE

CROSS-REFERENCE TO RELATED APPLICATION

This application is a divisional of U.S. application Ser. No. 11/039,177 filed Jan. 20, 2005, entitled *Method for Protecting from Unauthorized Access One or More Ports of a System Integrated into a Structure for Injection of a Material into One or More Cavities in the Structure*, which is a continuation of U.S. application Ser. No. 10/970,071 filed Oct. 20, 2004, entitled *Port Cover for a System Integrated Into a Structure for Injection of a Material Into One or More Cavities in the Structure*, which claims priority under 35 U.S.C. § 119(e) of provisional application Ser. No. 60/572,288 filed May 18, 2004.

TECHNICAL FIELD

This invention relates generally to systems integrated into structures for injection of materials into cavities of the structures, and more particularly to a key for engaging a locking mechanism of a port cover for protecting from unauthorized access one or more ports of a system integrated into a structure for injection of a material into one or more cavities in the structure.

BACKGROUND

A structure such as a home or building may include a system integrated into the structure for injection of a material into one or more cavities in the structure. For example, the material may include pesticide and the cavities may include stud bays, crawl spaces, or any other suitable cavities according to particular needs. In this example, a number of externally accessible ports may each be coupled to a tube that passes through one or more cavities and includes perforations through which the injected pesticide is released into the one or more cavities to provide pest control. The externally accessible ports may be accessible to any suitable service provider, such as an exterminator, who may connect a device to the externally accessible ports to inject the material, such as pesticide, into the one or more cavities. This may be undesirable if a particular service provider, such as may be associated with the construction of the structure, desires to be the exclusive provider of such services. Merely covering the one or more externally accessible ports inadequately prevents unauthorized access to the ports.

SUMMARY OF THE INVENTION

According to the present invention, disadvantages and problems associated with previous techniques for preventing unauthorized access to ports of a system integrated into a structure for injection of a material into cavities in the structure may be reduced or eliminated.

In certain embodiments, the present invention includes a key for engaging a locking mechanism for a port cover for use in a system integrated into a structure for injection of a material into one or more cavities in the structure. The locking mechanism is for removably securing a cover of the port cover to a base of the port cover that is coupled to the structure and includes one or more ports for injecting material into the one or more cavities in the structure. The key is adapted to engage with the locking mechanism, and orient the locking mechanism such that the locking mechanism engages with a projection of the base to removably secure one or more tabs of the cover in engagement with one or more corresponding slots of the base to removably secure the cover to the base to prevent unauthorized access to the one or more ports.

Particular embodiments of the present invention may provide one or more technical advantages. For example, it may be desirable to substantially prevent unauthorized access to ports for injection of material into cavities in a structure. Additionally, it may be desirable to provide evidence that a port cover for preventing such access to the ports has been forcibly breached. These objectives may be desirable if a particular service provider for injection of the material into the cavities desires to control access to the ports. In certain embodiments, the overall shape and design of the port cover may help prevent the port cover from being forcibly breached. In certain embodiments, when the locking mechanism is engaged with the projection of the base and the one or more tabs of the cover are engaged with the one or more corresponding slots of the base, the cover may not be removed from the base without breaking the one or more tabs of the cover. Breakage of one or more of the tabs may make it difficult or impossible to replace the cover on the base, which may deter attempts to forcibly breach the port cover and may also provide evidence that the port cover has been forcibly breached.

Certain embodiments of the present invention may provide some, all, or none of the above technical advantages. Certain embodiments may provide one or more other technical advantages, one or more of which may be readily apparent to those skilled in the art from the figures, descriptions, and claims included herein.

BRIEF DESCRIPTION OF THE DRAWINGS

For a more complete understanding of the present invention and features and advantages thereof, reference is now made to the following description, taken in conjunction with the accompanying drawings, in which:

FIGS. 1A–1B illustrate an example port cover for a system integrated into a structure for injection of a material into one or more cavities in the structure;

DESCRIPTION OF EXAMPLE EMBODIMENTS

Figure 14:
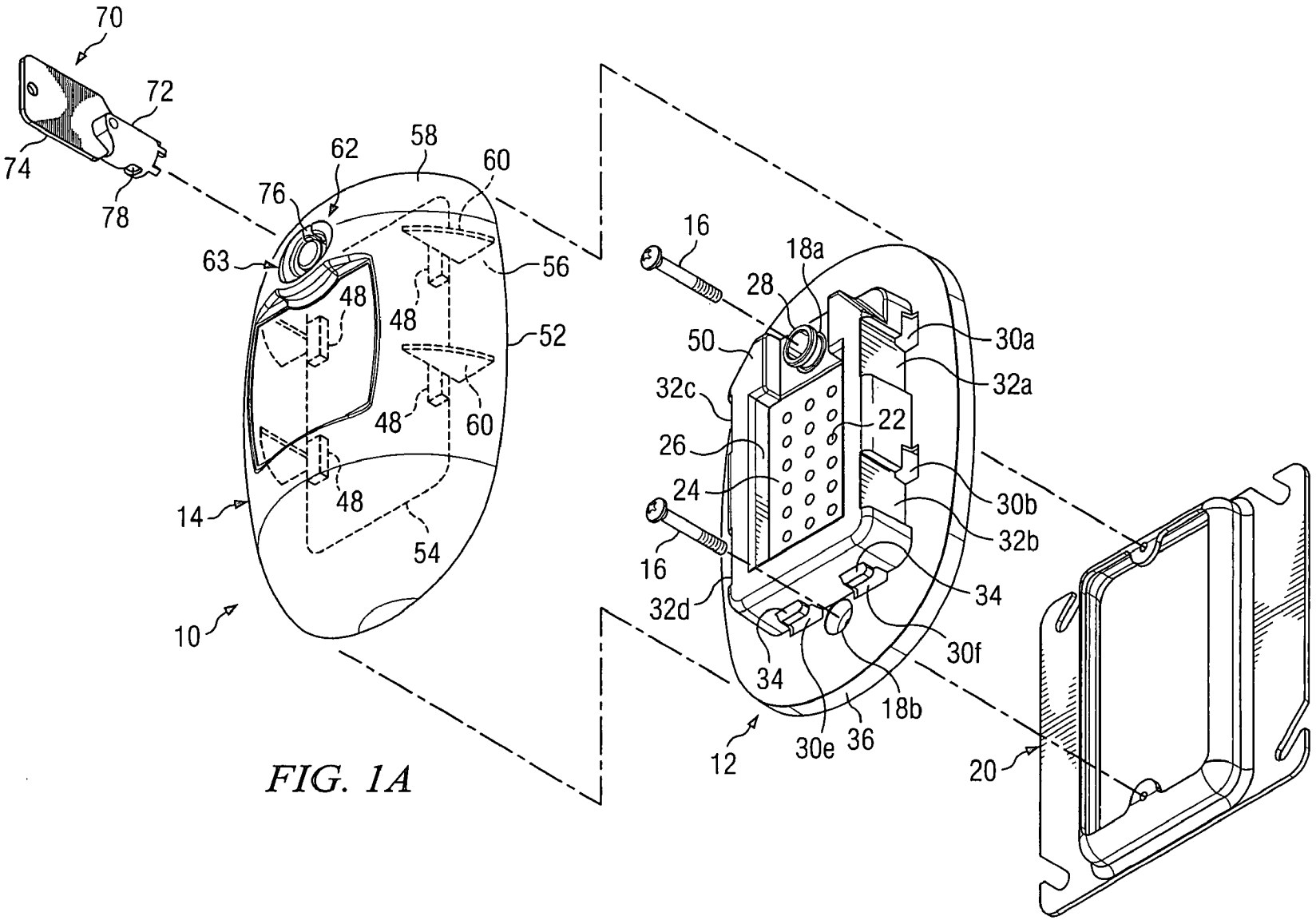
Figure 1B:
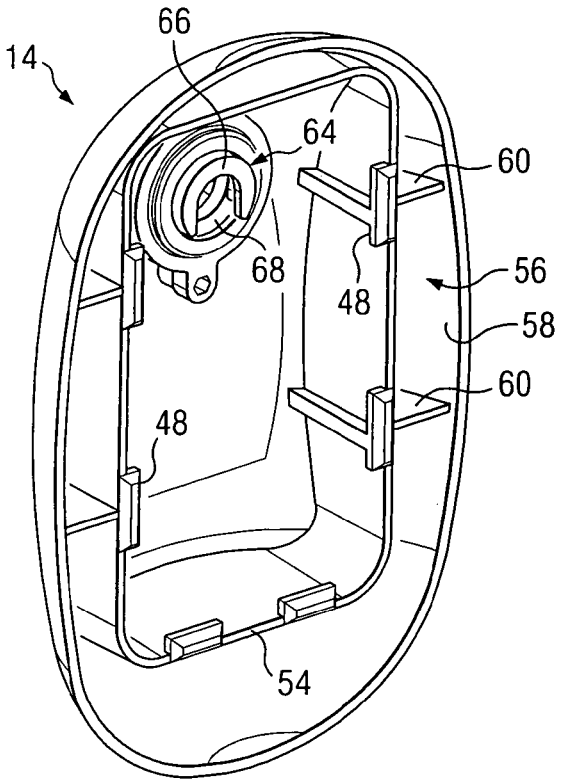

FIGS. 1A–1B illustrate an example port cover 10 for a system integrated into a structure for injection of a material into one or more cavities in the structure. For example, the material may include pesticide, the structure may include a building, a home, or any other suitable structure, and the cavities may include stud bays, crawl spaces, or any other suitable cavities according to particular needs. In this example, a number of externally accessible ports may each be coupled to a tube that passes through one or more cavities and includes perforations through which the injected pesticide is released into the one or more cavities to provide pest control. Port cover 10 may have an overall shape that makes it attractive, but hinders or deters forcible breach of port cover 10.

Port cover 10 includes a base 12 for permanently coupling to the structure and a cover 14 for removably coupling to base 12. For example, base 12 may be permanently coupled to the structure using one or more screws 16 inserted in corresponding openings 18 of base 12. Although a particular number of screws 16 and corresponding openings 18 are illustrated, the present invention contemplates base 12 including any suitable number of openings 18 for engaging screws 16. Furthermore, although screws 16 are described, the present invention contemplates using nails are other suitable fasteners for permanently coupling base 12 to the structure. In certain embodiments, base 12 may be coupled to the structure using a bracket 20. Although bracket 20 is illustrated as having a particular construction and shape, the present invention contemplates bracket 20 comprising any suitable construction and shape. Furthermore, the present invention contemplates mounting base 12 directly to the structure without the use of bracket 20. Bracket 20 may also be referred to as a "mud flap."

Base 12 may include one or more port holes 22 associated with a tub insert 24 for injection of the material through corresponding tubes into cavities in the structure. For example, a service representative, such as an exterminator, may connect a device to port holes 22 to inject the material, such as pesticide, into the one or more cavities. Although a particular number of port holes 22 are illustrated, the present invention contemplates base 12 including any suitable number of port holes 22 each having any suitable size according to particular needs. Port holes 22 may be associated one or more ports of base 12 underlying tube insert 24, as described in more detail with reference to FIG. 2. Tube insert 24 may help facilitate connection of the device for injection of the material (e.g., pesticide) into the structure via the underlying ports. The underlying ports of base 12 are preferably sized to snugly accommodate corresponding tubes, and may be crimped or otherwise formed to secure the tubes in place. In certain embodiments, port holes 22 and the underlying ports are recessed from a wall 26 of base 12.

Base 12 includes a projection 28. In certain embodiments, projection 28 is associated with one of the openings 18 (e.g., opening 18*a*) for engaging a screw 16. In such embodiments, it may be desirable for projection 28 to be hollow so that a screw 16 may be inserted through projection 28 into opening 18*a*. In certain embodiments, projection 28 is formed of the same material as and is integral to base 12. In embodiments in which projection 28 is associated with an opening for insertion of a screw 16, opening 18*a* extends through projection 28. In certain other embodiments, projection 28 is not associated with opening 18*a* for insertion of a screw 16, and projection may be solid. In yet other embodiments, projection 28 is an insert for inserting into opening 18*a*. For example, projection 28 of base 12 may be an insert made of metal or another suitable material, which can be slid into opening 18*a* of base 12. In certain embodiments in which projection 28 of base 12 is an insert, it may be desirable for the insert to be hollow so as not to impede access to opening 18*a*, for insertion of a screw 16 for example.

Base 12 may include one or more slots 30. Although a particular number of slots 30 are illustrated, the present invention contemplates base 12 including any suitable number of slots 30, according to particular needs. Base 12 may also include one or more channels 32 each associated with a corresponding slot 30. As can be seen in the embodiment of base 12 illustrated in FIG. 1A, certain slots 30 (e.g., slots 30*e* and 30*f*) may not be associated with a corresponding channel 32. In such embodiments, slots 30*e* and 30*f* may be associated with a tab 34. A perimeter 36 of base 12 may be substantially oval-shaped, although the present invention contemplates perimeter 36 of base 12 having any suitable shape, according to particular needs. Base 12 may be constructed using any suitable material, preferably a hard material such as plastic or metal.

Figure 2:
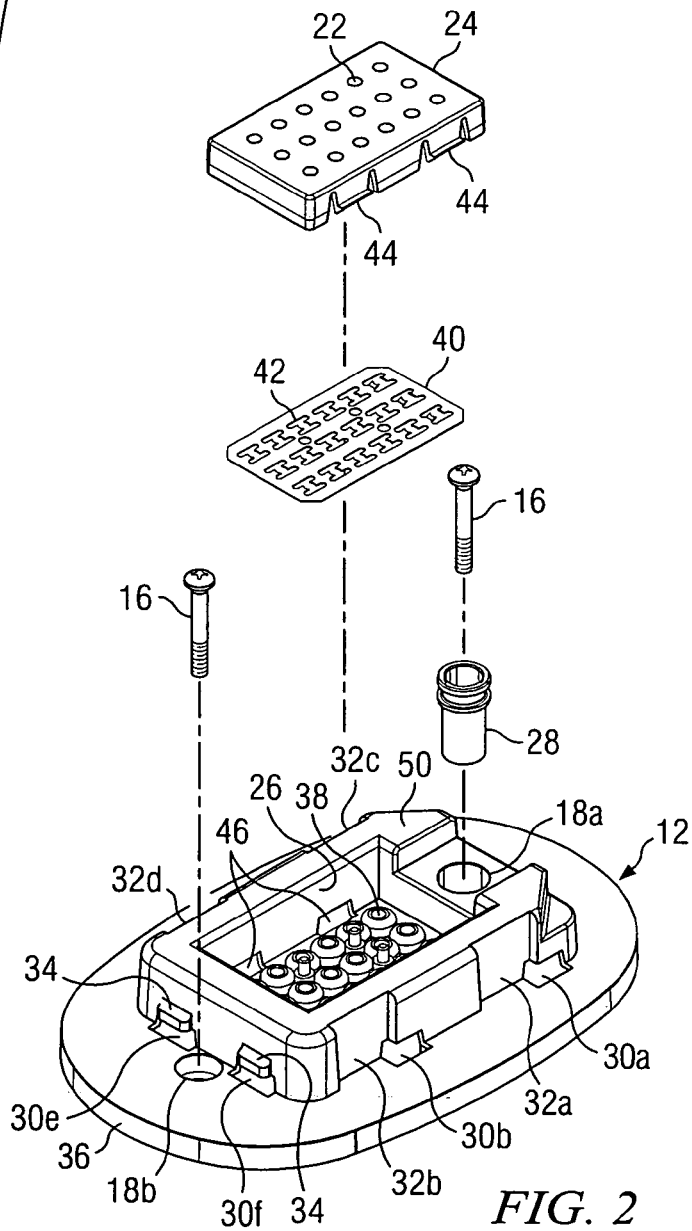
FIG. 2 illustrates an exploded view of a base showing example components of the base.

FIG. 2 illustrates an exploded view of base 12 showing example components of base 12. In the embodiment illustrated in FIG. 2, projection 28 of base 12 is an insert for inserting into opening 18*a* in base 12. As discussed above, base 12 may be coupled to the structure using one or more screws 16. In embodiments in which projection 28 is an insert for inserting into opening 18*a* (such as is illustrated in FIG. 2), screw 16 may be used to permanently couple projection 28 to base 12 when base 12 is permanently coupled to the structure using a screw 16 inserted into opening 18*a*.

Base 12 includes one or more ports 38, which may each be coupled to a tube that passes through one or more cavities and includes perforations through which the injected material (e.g., pesticide) is released into the one or more cavities to provide a service (e.g., pest control), as described above with reference to FIG. 1. Ports 38 of base 12 are preferably sized to snugly accommodate corresponding tubes, and may be crimped or otherwise formed to secure the tubes in place. In certain embodiments, ports 38 are recessed from wall 26 of base 12. Although a particular number of ports 38 are illustrated, the present invention contemplates base 12 including any suitable number of ports 38, according to particular needs.

In certain embodiments, a retainer plate 40 may be inserted over ports 38 of base 12, between tube insert 24 and ports 38 for example. Retainer plate 40 may include one or more slits 42 so that the material injected into the structure using port cover 10 (e.g., via tube insert 24) may pass through retainer plate 40 and be injected into the structure through ports 38. Slits 42 may have any suitable size and shape, according to particular needs.

Tube insert 24 may be mounted over retainer plate 40 and ports 38. Tube insert 24 may include one or more tabs 44, which may be inserted into and are adapted to engage with corresponding slots 46 of base 12, helping to secure tube insert 24 to base 12. Tube insert 24 preferably includes a number of port holes 22 equal to the number of ports 38, although this is not required. Although tube insert 24 and retainer plate 40 are described, the present invention contemplates port cover 10 with or without either tube insert 24 or retainer plate 40. For example, in embodiments in which neither tube insert 24 nor retainer plate 40 are included in port cover 10, a device for injection of the material into one or more cavities of the structure may be directly attached to ports 38 of base 12. As another example, in embodiments in which retainer plate 40 is not included in port cover 10, tube insert 24 may be mounted directly over ports 38.

Returning to FIGS. 1A and 1B, cover 14 may include one or more tabs 48 adapted to engage with one or more corresponding slots 30 of base 12. Although a particular number of tabs 48 are illustrated, the present invention contemplates cover 14 including any suitable number of tabs 48 according to particular needs. In one embodiment, the number of tabs 48 of cover 14 is equivalent to the number of slots 30 of base 12. In certain embodiments, one or more of slots 30 (e.g., slots 30*e* and 30*f*) are each associated with a tab 34 of base 12, which may help prevent the cover from being forcibly pulled perpendicular to a surface 50 of base 12 when cover 14 is secured to base 12 to help prevent port cover 10 from being forcibly breached. A perimeter 52 of cover 14 may be substantially oval-shaped, although the present invention contemplates perimeter 52 of cover 14 having any suitable shape, according to particular needs. In certain embodiments, perimeter 36 of base 12 and perimeter 52 of cover 14 have matching substantially oval-shapes, and perimeters 36 and 52 substantially align when cover 14 is secured to base 12 to help prevent port cover 10 from being forcibly breached. Although the present invention contemplates cover 14 having any suitable shape, it may be preferable for cover 14 to be dome-shaped or otherwise lack sharp edges to further hinder or deter forcible breach of port cover 10. Cover 14 may be constructed using any suitable material, preferably a hard material such as plastic or metal.

In certain embodiments, cover 14 may include an interior frame 54 that includes tabs 48, a void 56 existing between an exterior wall 58 and interior frame 54 of cover 14. Cover 14 may include one or more buttresses 60 in void 56, each buttress 60 connecting a corresponding portion of interior frame 54 to a corresponding portion of exterior wall 58, buttresses 60 helping to prevent port cover 10 from being forcibly breached when cover 14 is secured to base 12.

Port cover 10 includes a locking mechanism 62 in an aperture 63 of cover 14 for removably securing cover 14 to base 12 to prevent unauthorized access to ports 38. As described in more detail below with reference to FIGS. 5A–5E, locking mechanism 62 is adapted to engage projection 28 of base 12 to removably secure tabs 48 of cover 14 in engagement with corresponding slots 30 of base 12 to removably secure cover 14 to base 12 to prevent unauthorized access to ports 38. In certain embodiments, when locking mechanism 62 is engaged with projection 28 of base 12 and tabs 48 of cover 14 are engaged with corresponding slots 30 of base 12, cover 14 cannot be removed from base 12 without breaking one or more of tabs 48 of cover 14. In certain embodiments, when tabs 48 of cover 14 are engaged with corresponding slots 30 of base 12, locking mechanism 62 being engaged with projection 28 of base 12 substantially prevents cover 14 from sliding downward substantially parallel to front surface 50 of base 12, and tabs 48 of cover 14 being engaged with corresponding slots 30 of base 12 substantially prevents cover 14 from being pulled substantially perpendicular to front surface 50 of base 12 or from sliding upward substantially parallel to front surface 50 of base 12.

In certain embodiments, locking mechanism 62 includes a rotatable member 64 having a perimeter 66 and a gap 68 in perimeter 66. Although rotatable member 64 is illustrated as being substantially horseshoe-shaped, the present invention contemplates rotatable member 64 having any suitable shape, according to particular needs, such that rotatable member 64 has a perimeter 66 and a gap 68 in perimeter 66. Rotatable member 64 is adapted to be rotated to engage with and disengage from projection 28 of base 12. For example, as described in more detail below with reference to FIGS. 5A–5E, locking mechanism 62 may be adapted to engage with a key 70 inserted in locking mechanism 62 and to be rotated using key 70. Key 70 includes a shaft 72 and a handle 74. In certain embodiments, cover 14 includes a tab 76 in aperture 63 tab 76 being adapted to engage a channel 78 of key 70 when channel 78 is aligned with tab 76 and key 70 is inserted into aperture 63 to engage locking mechanism 62.

In certain embodiments, when rotatable member 64 is in a first rotational orientation, rotatable member 64 is adapted to receive, via gap 68 in perimeter 66, projection 28 of base 12 and to allow tabs 48 of cover 14 to slide upward substantially parallel to front surface 50 of base 12 to engage with corresponding slots 30 of base 12 to secure cover 14 to base 12. In alternative embodiments, slots 30 of base 12 may be oriented such that tabs 48 of cover 14 slide downward substantially parallel to front surface 50 of base 12 to engage with corresponding slots 30 of base 12. Tabs 48 may be adapted to move inward substantially perpendicular to front surface 50 of base 12 through corresponding channels 32 of base 12 before sliding upward (or downward) to engage corresponding slots 30 of base 12.

When rotatable member 64 is in a second rotational orientation, rotatable member 64 is prevented from disengaging with projection 28 of base 12, to substantially prevent tabs 48 of cover 14 from sliding downward substantially parallel to front surface 50 of base 12 to disengage from corresponding slots 30 of base 12 to secure cover 14 to base 12.

When rotatable member 64 is returned to the first rotational orientation, rotatable member 64 is adapted to release, via gap 68 in perimeter 66, projection 28 of base 12 and to allow tabs 48 of cover 14 to slide downward substantially parallel to front surface 50 of base 12 to disengage from corresponding slots 30 of base 12 to remove cover 14 from base 12. In alternative embodiments, slots 30 of base 12 may be oriented such that tabs 48 of cover 14 slide upward substantially parallel to front surface 50 of base 12 to disengage from corresponding slots 30 of base 12. Tabs 48 may be adapted to, after sliding downward (or upward) to disengage from corresponding slots 30 of base 12, move outward substantially perpendicular to front surface 50 of base 12 through corresponding channels 32 of base 12.

In certain embodiments, the first rotational orientation comprises at least one of a first range of rotational orientations, and the second rotational orientation comprises at least one of a second range of rotational orientations. For example, the first range of rotational orientations may include the rotational orientations at which rotatable member 64 is allowed to engage with by receiving and releasing projection 28 via gap 68 in perimeter 66 and the second range of rotational orientations may include the rotational orientations at which rotatable member 64 is prevented from disengaging with projection 28 via gap 68 in perimeter 66.

Figure 3A:
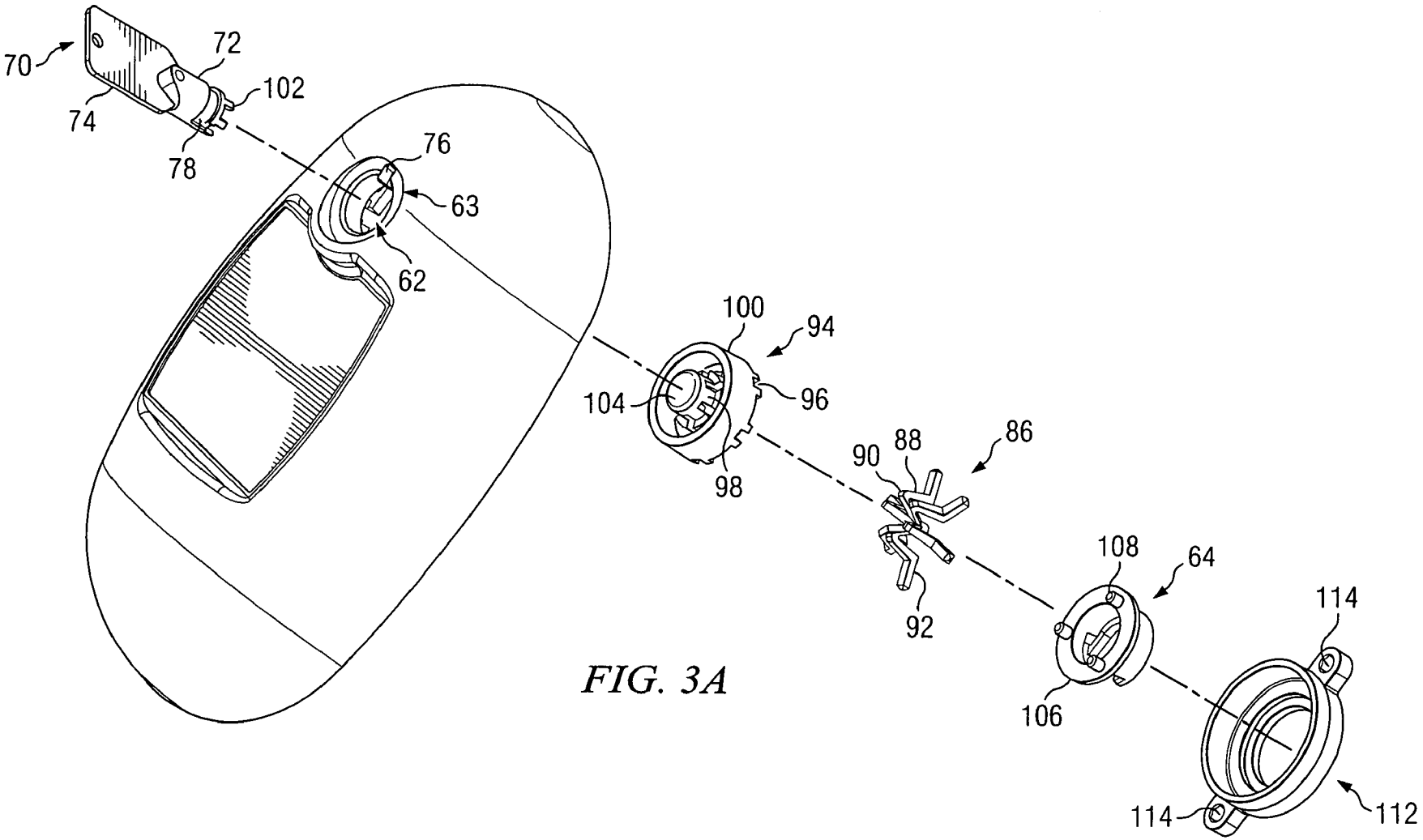
FIGS. 3A–3B illustrate front and rear views, respectively, of an example cover and front and rear exploded views, respectively, of an example locking mechanism for removably securing the cover to the base to prevent unauthorized access to one or more ports.
Figure 3B:
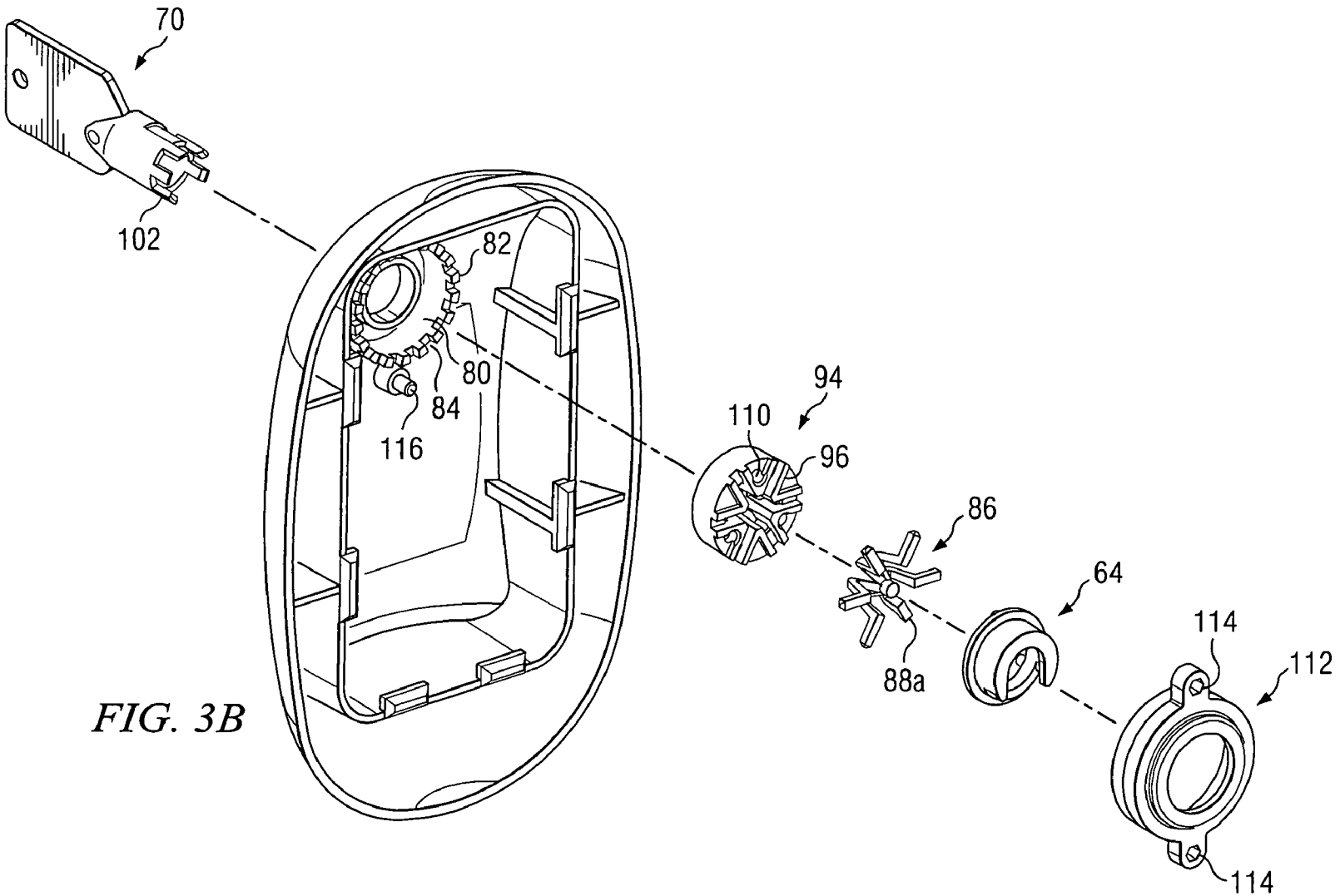

FIGS. 3A–3B illustrate front and rear views, respectively, of an example cover 14 and front and rear exploded views, respectively, of an example locking mechanism 62 for removably securing cover 14 to base 12 to prevent unauthorized access to ports 38. Cover 14 includes a castellated member 80, which includes a plurality of castellations 82. In certain embodiments, castellated member 80 is substantially circular in shape, castellations 82 being in a substantially circular arrangement. Although a particular number of castellations 82 are illustrated, the present invention contemplates castellated member 80 including any suitable number of castellations 82, according to particular needs. A slot 84 separates each pair of adjacent castellations 82. Slots 84 may have any suitable width, according to particular needs.

Locking mechanism 62 includes a tumbler 86 adapted to engage castellated member 80. Tumbler 86 includes a plurality of legs 88 arranged in a substantially circular fashion. In certain embodiments, legs 88 are angled away from a center of the circle at joints 90 of legs 88. One or more of the legs 88 each include a projection 92 adapted to extend into a corresponding slot 84 of castellated member 80 that separates adjacent castellations 82. In certain embodiments, one or more of legs 88 lack a projection 92 (e.g., leg 88*a*) for reasons described in more detail below with reference to FIGS. 5A–5E. In certain embodiments, the width of slots 84 is only slightly greater than a width of the corresponding legs 88 of tumbler 86.

Locking mechanism 62 includes a lock plug 94 adapted to receive tumbler 86. For example, lock plug 94 may include a plurality of channels 96 each adapted to receive a corresponding leg 88 of tumbler 86, joints 90 of legs 88 being exposed in lock plug 94 at end portions 98 of channels 96. In certain embodiments, the width of channels 96 of lock plug 94 is only slightly greater than the width of corresponding legs 88 of tumbler 86. A perimeter 100 of lock plug 94 may have a substantially tubular shape. Lock plug 94 is further adapted to engage projections 102 of key 74 at end portions 98 of channels 96, as described in greater detail below with reference to FIGS. 5A–5E. Lock plug 94 may include a substantially tubular member 104 extending into aperture 63 of cover 14 adapted to receive key 74. Projections 92 of legs 88 of tumbler 86 extend beyond perimeter 100 of lock plug 94, such that projections 92 extend into corresponding slots 84 of castellated member 80 to prevent rotation of lock plug 94.

Locking mechanism 62 includes rotatable member 64, which is adapted to engage projection 28 of base 12 as described briefly above with reference to FIGS. 1A and 1B, and in more detail below with reference to FIGS. 5A–5E. Rotatable member 64 may include a base ring 106, which may include one or more knobs 108 each adapted to engage with a corresponding aperture 110 in lock plug 94. Knobs 108 engaging with corresponding apertures 110 of lock plug 94 may help secure projections 92 of legs 88 in corresponding channels 96 of lock plug 94.

In certain embodiments, locking mechanism 62 includes a housing 112 adapted to seat over rotatable member 64 to maintain rotatable member 64 in continuous contact with lock plug 94, legs 88 of tumbler 86 in continuous contact with lock plug 94 and rotatable member 64, and lock plug 94 in continuous contact with cover 14. For example, housing 112 may help hold the components of locking mechanism 62 together. In certain embodiments, housing 112 includes one or more apertures 114, which may permanently or removably engage with one or more corresponding projections 116 of cover 14.

Channels of lock plug 94 and legs 88 of tumbler 86 are adapted to engage with key 70 inserted into locking mechanism 62. For example, channels 96 of lock plug 94 are adapted to receive projections 102 of key 70, one or more of the projections 102 of key 70 being adapted to, when the key is appropriately oriented, disengage projections 92 of the one or more legs 88 of tumbler 86 from the corresponding slots 84 of adjacent castellations 82 to allow lock plug 94 to be rotated using key 70. In certain embodiments, projections 102 of key 70 are adapted to compress legs 88 of tumbler 86 inward to recess projections 92 of tumbler 86 from slots 84 of castellated member 80 such that projections 92 clear castellations 82. Projections 92 of tumbler 86 being recessed from slots 84 of castellated member 80 allows lock plug 94 to be rotated using key 70, rotating rotatable member 64.

Figure 4:
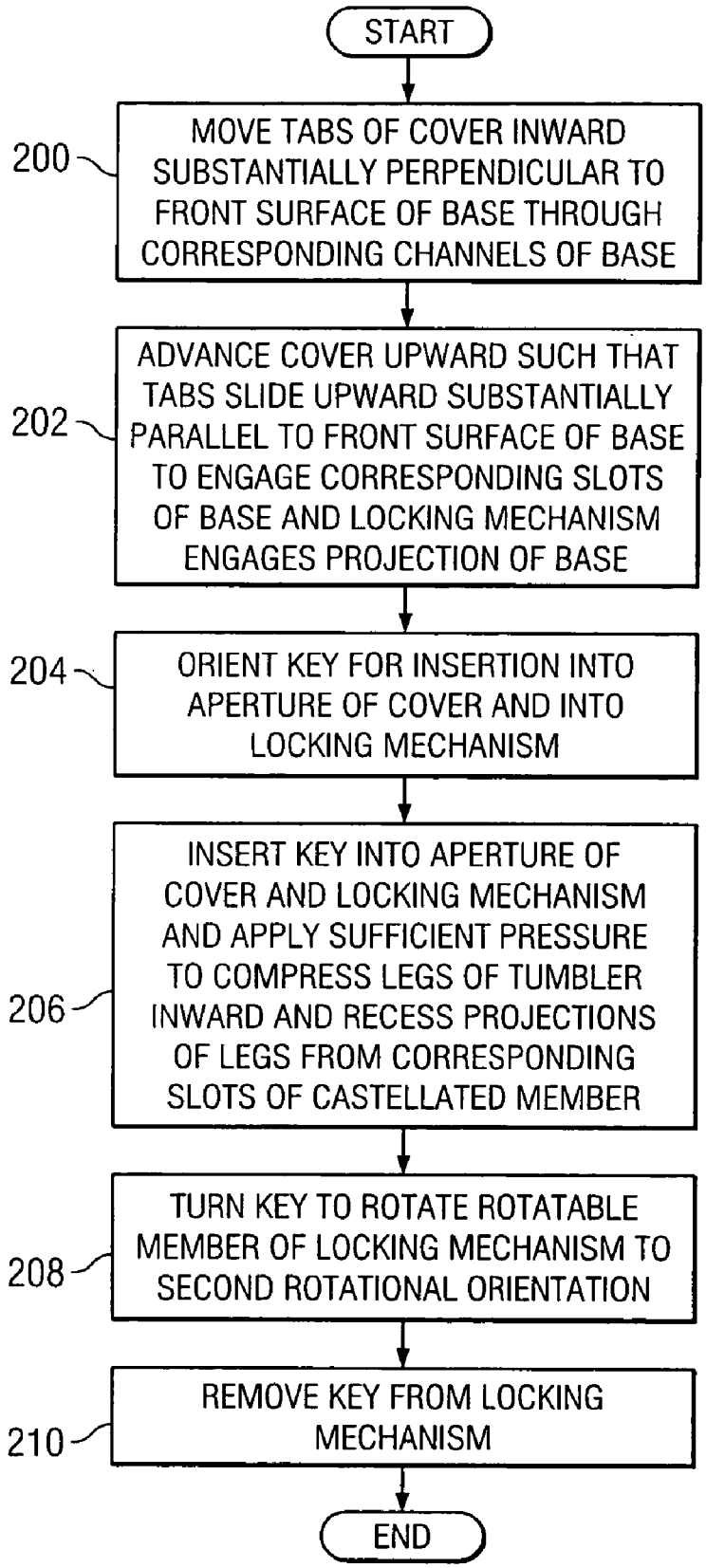
FIG. 4 illustrates an example method for securing the cover to the base.
Figure 5A:
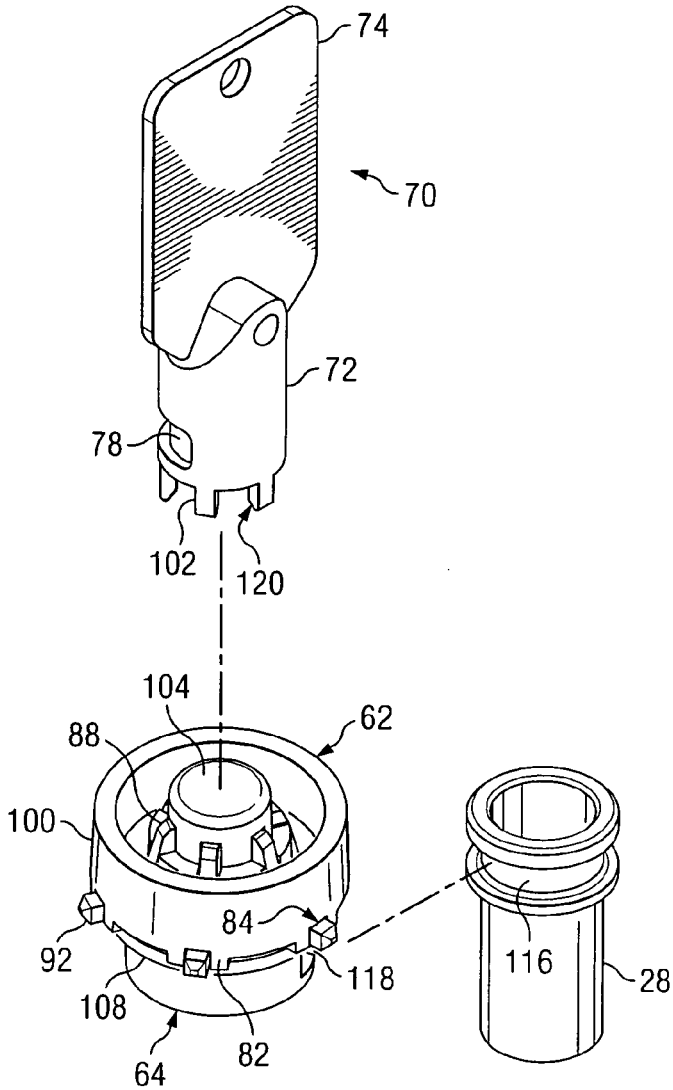
FIGS. 5A–5E illustrate an example process for engaging a rotatable member of a locking mechanism with a projection of the base using a key according to one embodiment of the present invention.
Figure 5B:
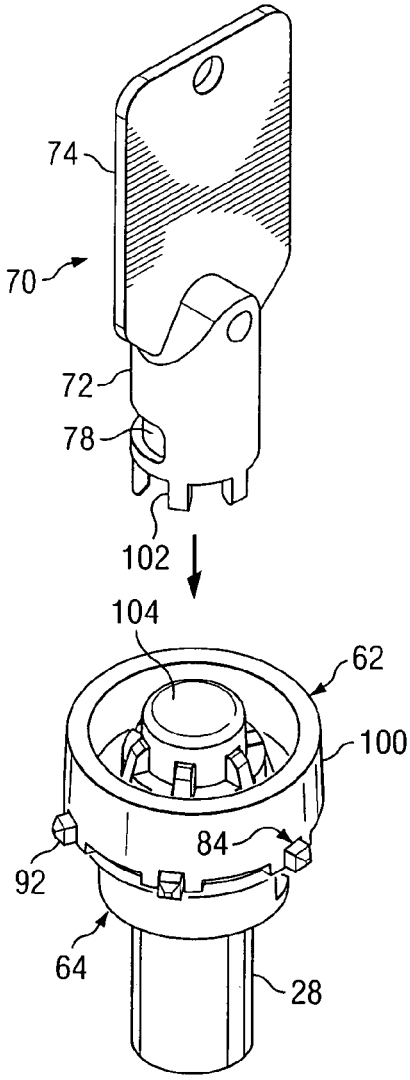
Figure 5E:
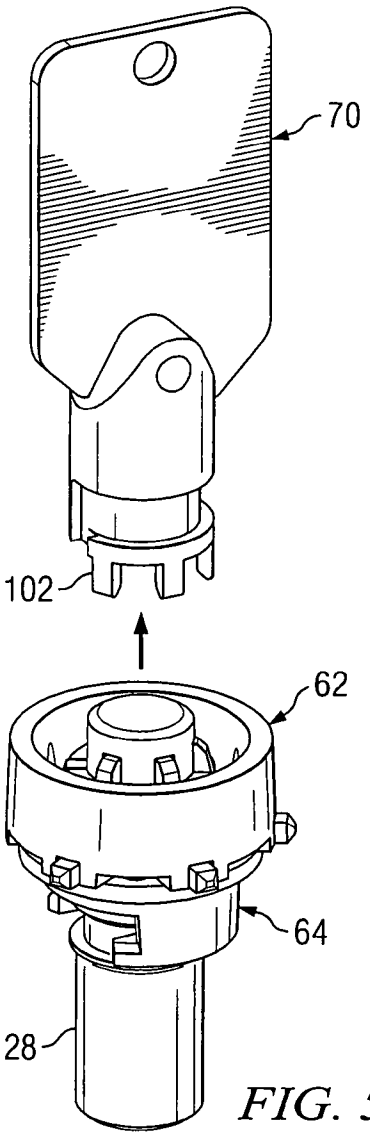
Figure 5D:
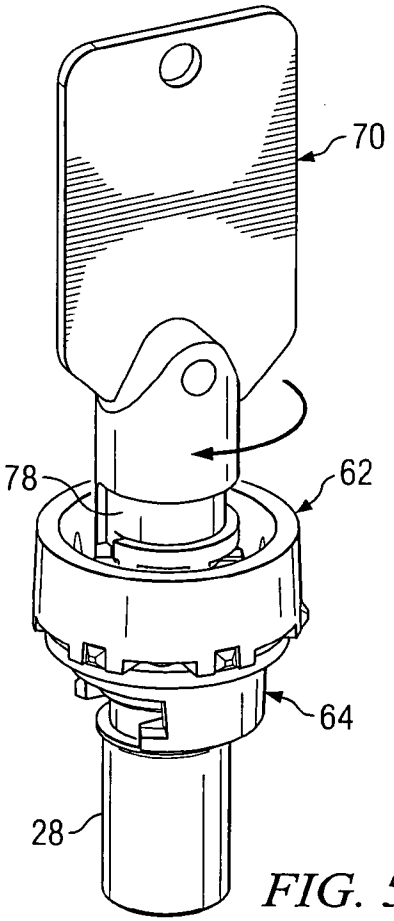
Figure 5C:
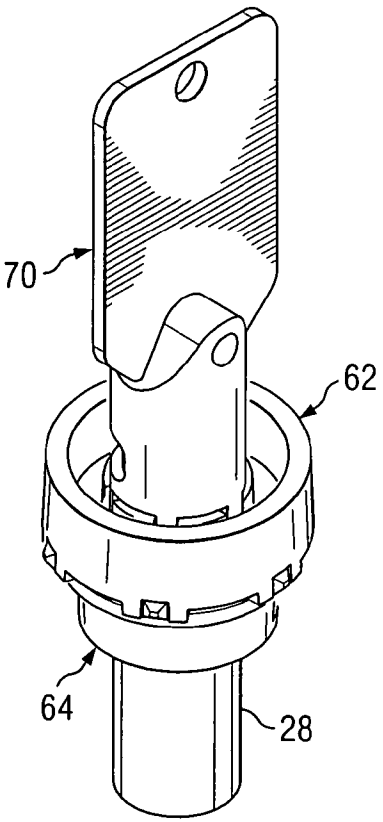

FIG. 4 illustrates an example method for securing cover 14 to base 12. FIG. 4 will be described in conjunction with FIGS. 5A–5E, which illustrate an example process for engaging rotatable member 64 of locking mechanism 62 with projection 28 of base 12 using key 70 according to one embodiment of the present invention. In particular, FIG. 5A illustrates key 70 and locking mechanism 62 with rotatable member 64 in a first rotational orientation such that it is adapted to receive projection 28 of base 12; FIG. 5B illustrates rotatable member 64 engaged with projection 28 in the first rotational orientation with key 70 oriented to engage with lock plug 94 and legs 88 of tumbler 86; FIG. 5C illustrates key 70 engaged with locking mechanism 62 with projections 92 of legs 88 recessed from slots 84; FIG. 5D illustrates the rotation of rotatable member 64 to a second rotational orientation using key 70 to secure rotatable member 64 in engagement with projection 28 of base 12 in the second rotational orientation; and FIG. 5E illustrates rotatable member 64 engaged with projection 28 of base 12 in the second rotational orientation and key 70 withdrawn from locking mechanism 62. It will be assumed for purposes of describing the example method of FIG. 4 that rotatable member 64 begins at the first rotational orientation such that rotatable member 64 is oriented to receive projection 28 of base 12 via gap 68 in perimeter 66 of rotatable member 64.

As shown in FIG. 4, at step 200, cover 14 is positioned such that tabs 48 of cover 14 are moved inward substantially perpendicular to front surface 50 of base 12 through corresponding channels 32 of base 12. At step 202, cover 14 is advanced upward such that tabs 48 slide upward substantially parallel to front surface 50 of base 12 and engage with corresponding slots 30 of base 12, and locking mechanism 62 engages projection 28 of base 12. For example, as illustrated in FIG. 5A, rotatable member 64 of locking mechanism 62 may be in a first rotational orientation such that rotatable member 64 is adapted to receive, via gap 68 in perimeter 66, projection 28 of base 12. In alternative embodiments, slots 30 of base 12 may be oriented such that tabs 48 of cover 14 slide downward substantially parallel to front surface 50 of base 12 to engage with corresponding slots 30 of base 12. In certain embodiments, projection 28 of base 12 includes a channel 116 and rotatable member 64 includes a ridge 118 adapted to engage with channel 116 of projection 28 when rotatable member 64 receives projection 28. Channel 116 of projection 28 and ridge 118 of rotatable member 64 may help prevent cover 14 from being pulled outward substantially perpendicular to front surface 50 of base 12 when cover 14 is secured to base 12.

At step 204, key 70 may be oriented for insertion into aperture 63 of cover 14 and into locking mechanism 62. For example, as shown in FIG. 5B, projections 102 of key 70 may be oriented to align with channels 96 of lock plug 94 and legs 88 of tumbler 86. In embodiments in which aperture 63 of base 12 includes tab 76, channel 78 of key 70 may be oriented such that channel 78 is aligned with tab 76 and can receive tab 76 as key 70 is inserted into aperture 63. In such embodiments, protrusions 102 of key 70 may be properly aligned with channels 96 of lock plug 94 and legs 88 of tumbler 86 when channel 78 of key 70 is aligned with tab 76 of aperture 63 if key 70 is properly "coded" to engage with locking mechanism 62.

For example, as shown in FIG. 5C, one or more of legs 88 of tumbler may include a joint 90 that is recessed from the other joints 90 of legs 88 of tumbler 86, and which does not include a corresponding projection 92. This may allow key 70 to be coded. For example, suppose tumbler 86 includes six legs 88, one of which includes a joint 90 that is recessed from the other joints 90 and does not include a projection 92. In order to rotate lock plug 94 associated with tumbler 86, the five projections 92 of the other five legs 88 should be recessed from corresponding slots 84 of castellated member 80; thus, the other five legs 88 should be compressed inward using key 70. However, if key 70 includes six projections 102, it may not be possible to insert key 70 into channels 96 of lock plug 94 due to the recessed joint 90, which may block a projection 102 of key 70 inserted into its corresponding channel 96. Furthermore, if key 70 does not have sufficient projections 102 or if projections 102 are in incorrect locations, key 70 will not be able to recess all projections 92 of legs 88, preventing rotatable member 64 from being rotated without breaking one or more projections 92 of legs 88.

At step 206, key 70 is inserted into aperture 63 of cover 14 and locking mechanism 62 according to the orientation described at step 204, and sufficient pressure is applied to compress legs 88 of tumbler 86 inward and recess projections 92 of legs 88 from corresponding slots 84 of castellated member 80. Recessing projections 92 of legs 88 from corresponding slots 84 of castellated member 80 may allow lock plug 94 to be rotated using key 70, thereby rotating rotatable member 64. For example, as shown in FIG. 5C, projections 102 of key 70 are engaged with corresponding legs 88 of tumbler 86 in channels 96 of lock plug 94, and projections 92 of legs 88 are recessed from corresponding slots 84 of castellated member 80 such that projections 92 clear castellations 82. This recession allows rotatable member 64 to be rotated using key 70 by rotating lock plug 94. In certain embodiments, end portions 120 of projections 102 of key 70, which engage with legs 88 of tumbler 86, are angled to facilitate inward compression of legs 88 for retracting projections 92 of legs 88 from corresponding slots 84 of castellated member 80.

At step 208, key 70, inserted in locking mechanism 62 and recessing projections 92 of legs 88 from corresponding slots 84 of castellated member 80, may be turned to rotate rotatable member 64 of locking mechanism 62 to the second rotational orientation for engaging with projection 28 of base 12. In certain embodiments, as illustrated in FIG. 5D, rotatable member 64 should be rotated approximately one hundred eighty degrees to engage with projection 28 of base 12. In embodiments in which shaft 72 of key 70 includes channel 78 for allowing tab 76 of aperture 63 of base 12 to pass through when inserting key 70 into locking mechanism 62, channel 78 of shaft 72 may extend around the perimeter of shaft 72 such that tab 76 of aperture 63 prevents key 70 from being turned beyond certain points in certain directions. For example, channel 78 of key 70 may prevent key 70 from being turned beyond approximately one hundred eighty degrees in a clockwise direction when turning key 70 to engage rotatable member 64 with projection 28.

At step 210, as shown in FIG. 5E, key 70 is removed from locking mechanism 62, releasing inward pressure on legs 88, allowing projections 92 of legs 88 to engage with corresponding slots 84 of castellated member 80, and removably securing tabs 48 of cover 14 with corresponding slots 30 of base 12 to removably secure cover 14 to base 12 to prevent unauthorized access to ports 38. In certain embodiments, when rotatable member 64 is in the second rotational orientation, rotatable member 64 is prevented from disengaging with projection 28 of base 12, to substantially prevent tabs 48 of cover 14 from sliding downward substantially parallel to front surface 50 of base 12 to disengage from corresponding slots 30 of base 12 to secure cover 14 to base 12.

Figure 6:
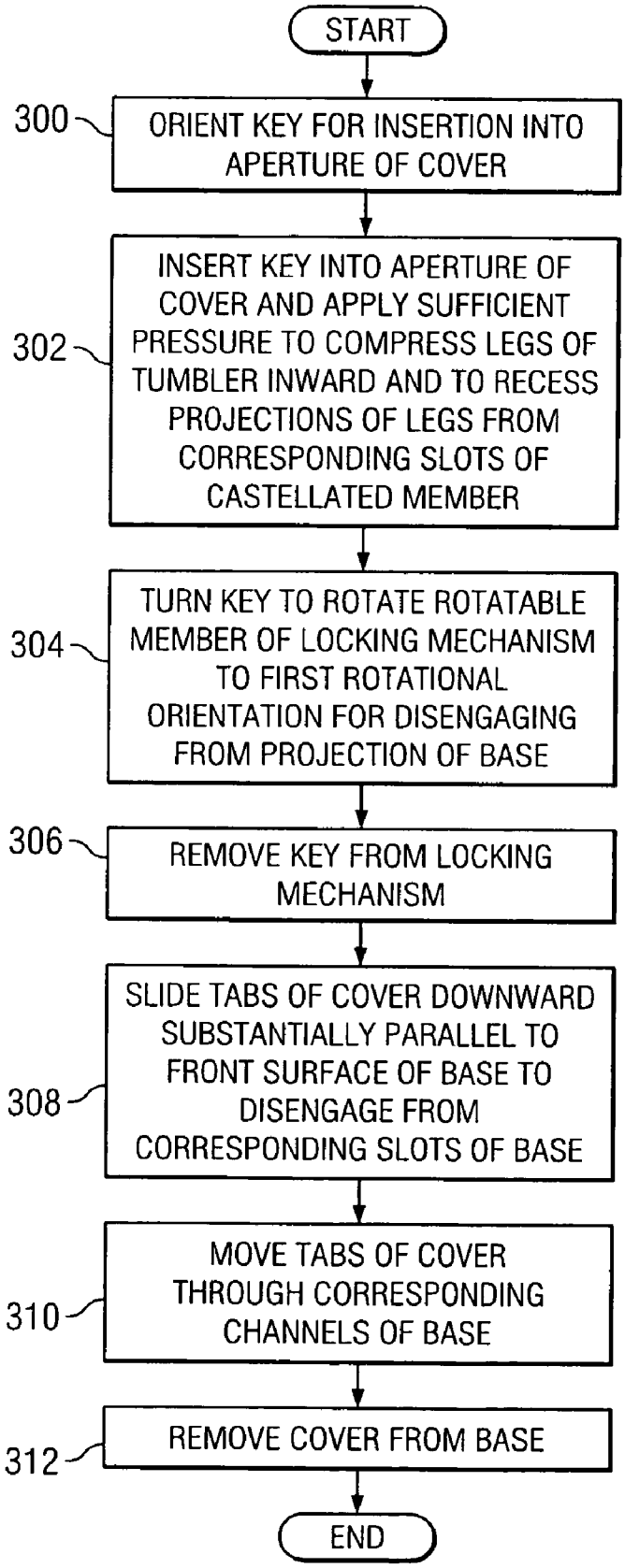
FIG. 6 illustrates an example method for removing the cover from the base.

FIG. 6 illustrates an example method for removing cover 14 from base 12. At step 300, key 70 may be oriented for insertion into aperture 64 of cover 14. For example, as shown in FIG. 5B, projections 102 of key 70 may be oriented to align with channels 96 of lock plug 94 and legs 88 of tumbler 86. In embodiments in which aperture 63 of base 12 includes tab 76, channel 78 of key 70 may be oriented such that channel 78 is aligned with tab 76. In such embodiments, projections 102 of key 70 may be properly aligned with channels 96 of lock plug 94 and legs 88 of tumbler 86 when channel 78 of key 70 is aligned with tab 76 of aperture 63 if key 70 is properly coded for locking mechanism 62 and port cover 14.

At step 302, key 70 is inserted into aperture 63 of cover 14 according to the orientation described at step 200, and sufficient pressure is applied to compress legs 88 of tumbler 86 inward and to recess projections 92 of legs 88 from corresponding slots 84 of castellated member 80. Recessing projections 92 of legs 88 from corresponding slots 84 of castellated member 80 may allow lock plug 94 to be rotated using key 70, thereby rotating rotatable member 64. For example, as shown in FIG. 5C, projections 102 of key 70 are engaged with corresponding legs 88 of tumbler 86 in channels 96 of lock plug 94, and projections 92 of legs 88 are recessed from corresponding slots 84 of castellated member 80 such that projections 92 clear castellations 82. This recession allows rotatable member 64 to be rotated using key 70 by rotating lock plug 94. As discussed above with reference to FIG. 4, key 70 may be coded such that only a properly coded key 70 may be used to compress legs 88 to recess projections 92 of legs 88 from corresponding slots 84 of castellated member 80.

At step 304, key 70, inserted in locking mechanism 62 and recessing projections 92 of legs 88 from corresponding slots 84 of castellated member 80, may be turned to rotate rotatable member 64 of locking mechanism 62 to the first rotational orientation for disengaging from projection 28 of base 12. In certain embodiments, rotatable member 64 should be rotated approximately one hundred eighty degrees to disengage with projection 28 of base 12. In embodiments in which shaft 72 of key 70 includes channel 78 for allowing tab 76 of aperture 63 of base 12 to pass through when inserting key 70 into locking mechanism 62, channel 78 of shaft 72 may extend around shaft 72 such that tab 76 prevents key 70 from being turned beyond certain points in certain directions. For example, channel 78 of key 70 may prevent key 70 from being turned beyond approximately one hundred eighty degrees in a counterclockwise direction when turning key 70 to disengage rotatable member 64 with projection 28, which may result in tab 76 being aligned with channel 78 of key 70.

At step 306, key 70 is removed from locking mechanism 62, releasing inward pressure on legs 88, allowing projections 92 of legs 88 to engage with corresponding slots 84 of castellated member 80, and locking rotatable member 64 in the first rotational orientation. At step 308, with rotatable member 64 in the second rotational orientation, tabs 48 of cover 14 slide downward substantially parallel to front surface 50 of base 12 to disengage from corresponding slots 30 of base 12. For example, cover 14 may be pulled by an authorized service technician downward substantially parallel to front surface 50 of base 12 to disengage tabs 48 of cover 14 from corresponding slots 30 of base 12. As another example, the force of gravity may be sufficient to pull cover 14 downward substantially parallel to front surface 50 of base 12 to disengage tabs 48 of cover 14 from corresponding slots 30 of base 12. In an alternative embodiment, slots 30 of base 12 may be oriented such that tabs 48 of cover 14 slide upward substantially parallel to front surface 50 of base 12 to disengage from corresponding slots 30 of base 12. At step 310, tabs 48 of cover 14 are moved outward substantially perpendicular to front surface 50 of base 12 through corresponding channels 32 of base 12. At step 312, cover 14 is removed from base 12 to allow access to ports 38. In practice, step 306 may be performed after removing cover 14 from base 12.

Particular embodiments of the present invention may provide one or more technical advantages. For example, it may be desirable to substantially prevent unauthorized access to ports 38 for injection of material into cavities in a structure. Additionally, it may be desirable to provide evidence that port cover 10 for preventing such access to ports 38 has been forcibly breached. These objectives may be desirable if a particular service provider for injection of the material into the cavities desires to control access to ports 38. In certain embodiments, the overall shape and design of port cover 10 may help prevent port cover 10 from being forcibly breached. In certain embodiments, when locking mechanism 62 is engaged with projection 28 of base 12 and tabs 48 of cover 14 are engaged with corresponding slots 30 of base 12, cover 14 may not be removed from base 12 without breaking one or more of tabs 48 of cover 14. Breakage of one or more of tabs 48 may make it difficult or impossible to replace cover 14 on base 12, which may deter attempts to forcibly breach port cover 10 and may also provide evidence that port cover 10 has been forcibly breached.

Although locking mechanism 62 has been described in the context of a port cover (e.g., port cover 10) for use in a system integrated into a structure for injection of a material into one or more cavities in the structure, the present invention contemplates using locking mechanism 62 for engaging with a projection of any suitable first component to removably secure any suitable second component to the first component for any suitable purpose. As just one example, locking mechanism 62 may be used to removably secure a door to a doorframe.

Although the present invention has been described with several embodiments, diverse changes, substitutions, variations, alterations, and modifications may be suggested to one skilled in the art, and it is intended that the invention encompass all such changes, substitutions, variations, alterations, and modifications as fall within the spirit and scope of the appended claims.

What is claimed is:

1. A key for engaging a locking mechanism for a port cover for use in a system integrated into a structure for injection of a material into one or more cavities in the structure, the locking mechanism for removably securing a cover of the port cover to a base of the port cover that is coupled to the structure and comprises one or more ports for injecting material into the one or more cavities in the structure, the cover comprising a plurality of castellations in a circular arrangement with a slot separating each pair of adjacent castellations, the locking mechanism comprising a rotatable member and a plurality of legs each comprising a joint and a projection adapted to extend into a corresponding slot of the cover separating adjacent castellations, at least one particular leg lacking a projection and having its joint recessed from the joints of the other legs and configured to prevent insertion into the locking mechanism of a key that includes a corresponding projection, the key:

configured to engage with the locking mechanism;

configured to orient the locking mechanism such that the locking mechanism engages with a projection of the base to removably secure one or more tabs of the cover in engagement with one or more corresponding slots of the base to removably secure the cover to the base to prevent unauthorized access to the one or more ports;

comprising:

a hollow shaft; and a plurality of projections extending from the shaft in a circular arrangement for engaging the locking mechanism to rotate the rotatable member;

one or more of the projections of the key configured to, when the key is properly oriented, compress inwardly corresponding legs of the locking mechanism to retract the projections of the corresponding legs from their corresponding slots of the cover to allow the rotatable member of the locking mechanism to be rotated using the key; and a gap, corresponding to the joint of the particular leg of the locking mechanism, that codes the key for use with the locking mechanism.

2. The key of claim 1, wherein when the locking mechanism is engaged with the projection of the base and the one or more tabs of the cover are engaged with the one or more corresponding slots of the base, the cover cannot be removed from the base without breaking the one or more tabs of the cover.

3. The key of claim 1, wherein when the one or more tabs of the cover are engaged with the one or more corresponding slots of the base:

the locking mechanism being engaged with the projection of the base substantially prevents the cover from sliding downward substantially parallel to a front surface of the base; and the one or more tabs of the cover being engaged with the one or more corresponding slots of the base substantially prevents the cover from being pulled substantially perpendicular to the front surface of the base or from sliding upward substantially parallel to the front surface of the base.

4. The key of claim 1, wherein: the rotatable member of the locking mechanism comprises a perimeter and a gap in the perimeter; and the key is adapted to:

position the rotatable member in a first rotational orientation such that the rotatable member is allowed to receive, via the gap in the perimeter, the projection of the base to allow the one or more tabs of the cover to slide upward substantially parallel to a front surface of the base to engage the one or more corresponding slots of the base to secure the cover to the base;

position the rotatable member in a second rotational orientation such that the rotatable member is prevented from disengaging with the projection of the base to substantially prevent the one or more tabs of the cover from sliding downward substantially parallel to a front surface of the base to disengage from the one or more corresponding slots of the base to secure the cover to the base; and return the rotatable member to the first rotational orientation to allow the rotatable member to release, via the gap in the perimeter, the projection of the base to allow the one or more tabs of the cover to slide downward substantially parallel to the front surface of the base to disengage from the one or more corresponding slots of the base to remove the cover from the base.

5. The key of claim 4, wherein:

the first rotational orientation comprises at least one of a first range of rotational orientations; and the second rotational orientation comprises at least one of a second range of rotational orientations.

6. The key of claim 4, wherein:

the projection of the base comprises a channel; and the key is adapted to orient the rotatable member such that a ridge of the rotatable member engages with the channel of the projection of the base, when the one or more tabs of the cover are engaged with the one or more corresponding slots of the base, to help prevent the cover from being forcibly removed from the base.

7. The key of claim 6, wherein:

the base comprises one or more channels each associated with a corresponding slot;

the one or more tabs of the cover are adapted to move inward substantially perpendicular to the front surface of the base through the one or more corresponding channels of the base before sliding upward to engage the one or more corresponding slots of the base to secure the cover to the base; and the one or more tabs of the cover are adapted to, after sliding downward to disengage from the one or more corresponding slots of the base, move outward substantially perpendicular to the front surface of the base through the one or more corresponding channels of the base to remove the cover from the base.

8. The key of claim 4, wherein:

the locking mechanism is adapted to engage with the key when the key is inserted into the locking mechanism; and the rotatable member is adapted to be rotated using the key.

9. The key of claim 8, comprising a handle.

10. The key of claim 1, wherein the locking mechanism further comprises a lock plug comprising a plurality of channels each adapted to receive a corresponding leg, the lock plug adapted to engage with the key to rotate the rotatable member.

11. The key of claim 1, wherein:

the shaft of the key comprises a channel; and the cover comprises an aperture comprising a tab, the aperture adapted to receive the key when the key is oriented such that the tab of the aperture can pass through the channel of the shaft of the key.

12. The key of claim 1, wherein the material comprises pesticide.

13. The key of claim 1, wherein each of the one or more projections of the key comprises an angular end portion configured to facilitate inward compression of the corresponding legs of the locking mechanism from their corresponding slots of the cover.

* * * * *